US006062110A

United States Patent [19]

Julio et al.

[11] Patent Number: 6,062,110

[45] Date of Patent: May 16, 2000

[54] WRENCH ADAPTED FOR PRESSURIZED GAS TANK VALVES

[76] Inventors: Frank Julio; Annette Julio, both of 28630 W. Hulen Rd., Gustine, Calif. 95322

[21] Appl. No.: 09/141,507

[22] Filed: Aug. 28, 1998

[51] Int. Cl.[7] ..... B25B 13/02

[52] U.S. Cl. ..... 81/124.2; 81/176.15; 81/125

[58] Field of Search ..... 81/119, 124.2, 81/176.1, 176.15, 125

[56] References Cited

U.S. PATENT DOCUMENTS 1,181,565 5/1916 Block ..... 81/124.2
1,855,586 4/1932 Nordstrom ..... 81/119 X
4,275,621 6/1981 Nakkitt ..... 81/124.2 X
5,335,569 8/1994 Rowley ..... 81/125
5,425,290 6/1995 Fought et al. ..... 81/125 X

*Primary Examiner*—James G. Smith
*Attorney, Agent, or Firm*—The Kline Law Firm

[57] ABSTRACT

A wrench specially adapted to fit on the valves on LPG tanks. The wrench will typically be supplied in a set, the set including a plurality of wrench elements of varying sizes to accommodate all common valve sizes. A chamber sleeve secures the wrench element in position on the subject valve. The chamber sleeve includes a through hole in an upper portion to receive an elongated handle that enables the user to easily apply a large amount of torque.

9 Claims, 3 Drawing Sheets

WRENCH ADAPTED FOR PRESSURIZED GAS TANK VALVES

FIELD OF THE INVENTION

The present invention relates generally to hand tools such as wrenches, and more particularly is a wrench set adapted to remove valves from pressurized gas tanks, particularly LPG (liquid propane gas) canisters.

BACKGROUND OF THE INVENTION

The search for alternative fuels has led to a widespread use of propane (LPG) as a power supply. Because of its convenient portable nature and clean burning characteristics, propane is used for may heating applications and in small motors. A common heating application for LPG is for crop dryers and grain bins. Propane engines are often utilized in situations that require a cleaner burning fuel than gasoline or diesel fuel. A common application for propane engines is for fork lifts used in enclosed manufacturing facilities, where carbon monoxide cannot be tolerated. Perhaps the industry which most heavily relies on LPG is the recreational vehicle industry. RV's use propane to power many of the appliances in the RV, and to heat the coaches.

Propane must be stored under pressure. All LPG storage vessels must therefore be sealable. Because the containers must also be reusable, all LPG containers are equipped with valves that can operate under the pressure required for the LPG storage.

In many instances, because of the geometry of the valve and the conformation of the containers, the valves are very difficult to remove from the containers for repair and replacement. It is very difficult to operate on the valves with standard wrenches, and there is no specialized tool that exists in the current art.

Accordingly, it is an object of the present invention to provide a tool that will enable a user to easily remove and install valves in LPG containers.

It is a further object of the present invention to make the tool adaptable for all sizes of containers and types of valves.

SUMMARY OF THE INVENTION

The present invention is a wrench specially adapted to fit on the valves on LPG tanks. The wrench will typically be supplied in a set, the set comprising a plurality of wrench elements of varying sizes to accommodate all common valve sizes. A chamber sleeve secures the wrench element in position on the subject valve. The chamber sleeve includes a through hole in an upper portion to receive an elongated handle that enables the user to easily apply a large amount of torque.

An advantage of the present invention is that it has a very small "footprint" at the insertion point, the point of entry of the valve into the LPG container. Because of the small footprint, the wrench can be easily applied to the valve even with the minimal space available around the base of the valve.

Another advantage of the present invention is that repairs and replacement of valves can be accomplished without removing guards and handles from the tanks.

A still further advantage of the present invention is that it is very easy to make different sizes of wrenches suitable for different size valves. The different sizes can be easily color coded for quick recognition.

Yet another advantage of the present invention is that it is adaptable to all types of pressure valves, including but not limited to filler valves, QCC valves, POL valves, and OPD valves.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
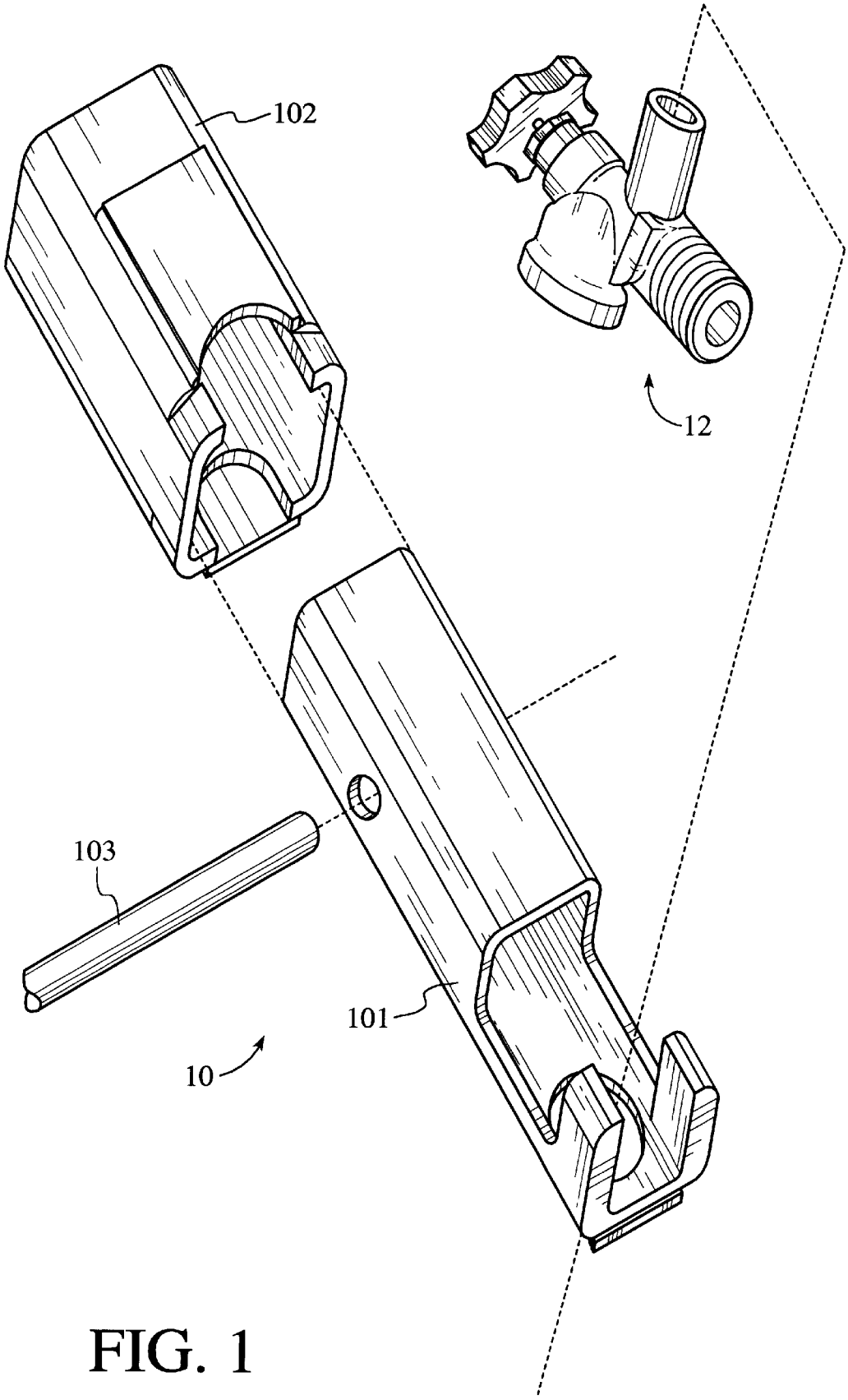
FIG. 1 is an exploded view of the wrench and a valve.
Figure 5:
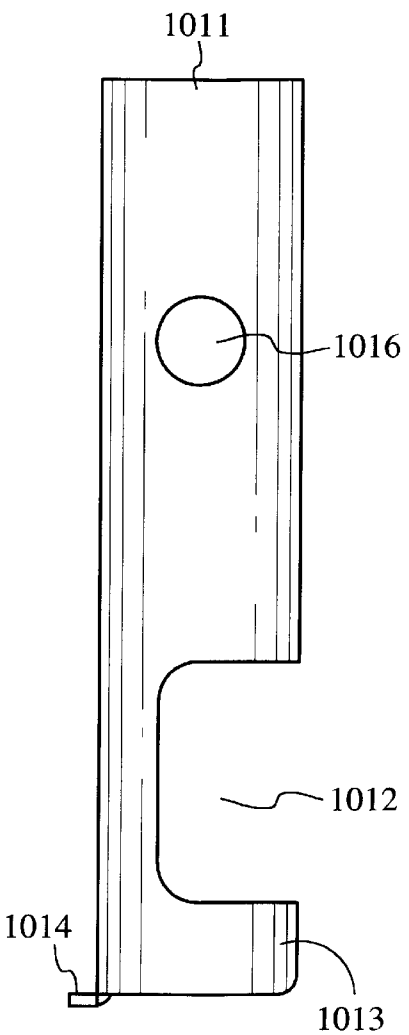
FIG. 5 is a left side view of the wrench element.
Figure 4:
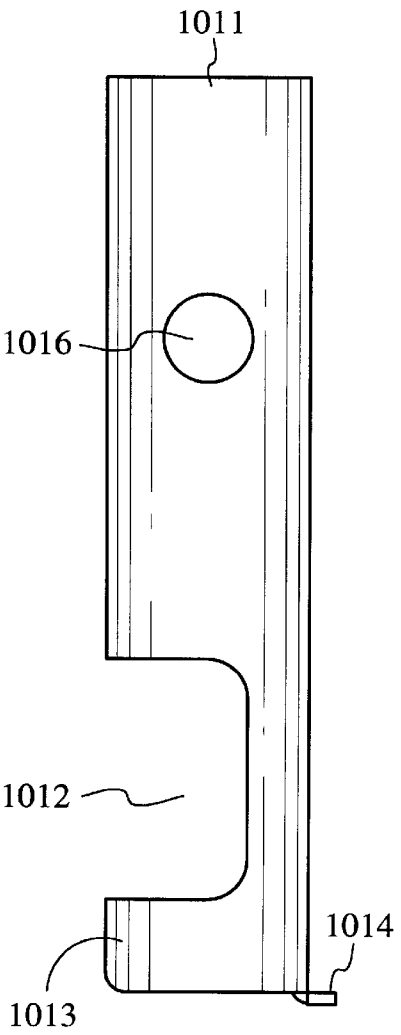
FIG. 4 is a right side view of the wrench element.
Figure 3:
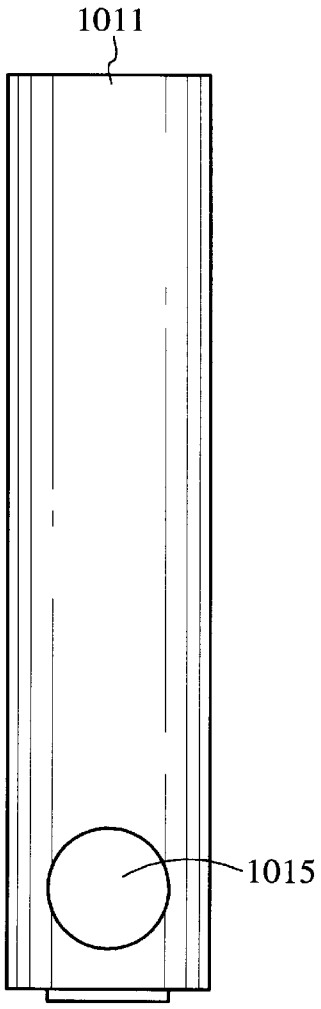
FIG. 3 is a rear view of the wrench element.
Figure 2:
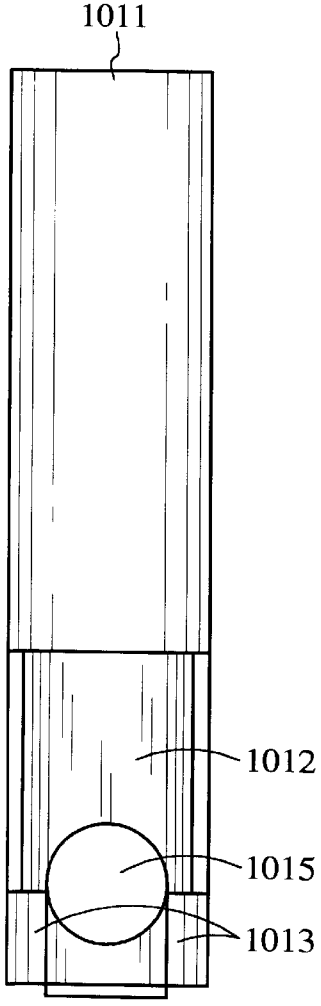
FIG. 2 is a front view of the wrench element.
Figures 6, 7, 8, 9:
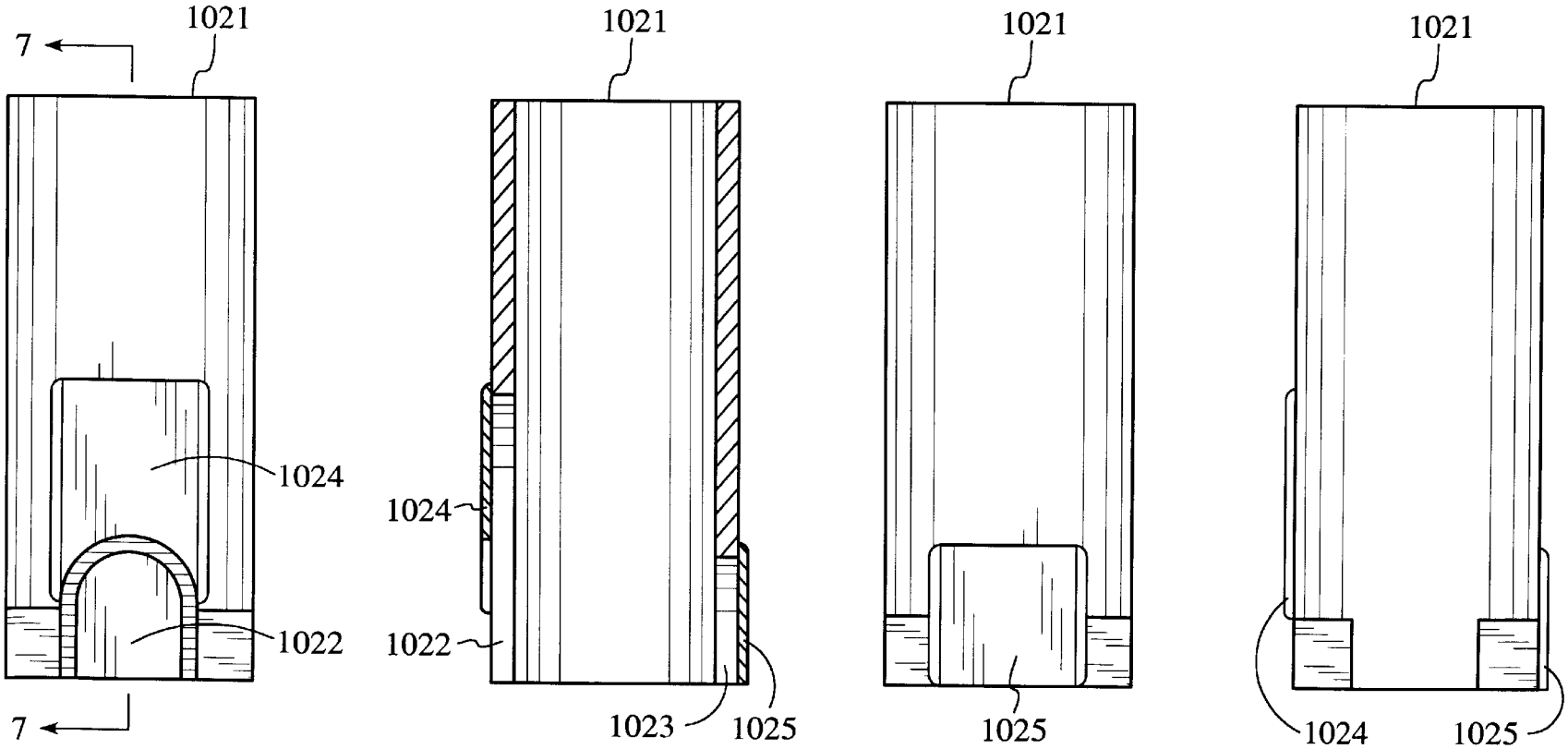
FIG. 6 is a front view of the chamber sleeve.
FIG. 7 is a view along line 7—7 in FIG. 6, showing a side cross section view of the chamber sleeve.
FIG. 8 is a rear view of the chamber sleeve.
FIG. 9 is a right side view of the chamber sleeve.

Referring first to FIG. 1, the present invention is a wrench 10 specially adapted to fit on a valve 12 of a pressurized gas canister or tank. The wrench 10 will typically be supplied in a set, the set comprising a plurality of wrench elements 101 of varying sizes to accommodate all common valve sizes. A chamber sleeve 102 secures the wrench element 101 in position on the subject valve 12. An elongated torque handle 103 is supplied to enable the user to easily apply torque to the valve 12.

The wrench element 101, shown in detail in FIGS. 2–5, comprises a tubular main body 1011 that is rectangular (square in the preferred embodiment) in cross section. The main body 1011 fits over the valve 12 so that the valve 12 is received in a cutout area 1012. The cutout area 1012 accommodates any protrusions on a front facing side of the valve 12. Either a safety valve or the outlet can extend from the front facing side of a typical valve 12.

Two securing arms 1013 extend forward from an inner side of a rear wall of the main body 1011 at a lower end of the cutout area 1012. The arms 1013 align with and abut the flat sides of the valve 12 so that the valve 12 is held securely in the wrench element 101. The size of valve that a given wrench element 101 accommodates is defined by the distance between the inner sides of the securing arms 1013. The size of the exterior of the main body 1011 of the wrench element 101 remains constant for all wrench elements in a set. Sizing of the wrench element is most easily controlled by adjusting the thickness (during the manufacturing process) of the securing arms 1013.

A restraining projection 1014 extends outward from an outer side of the rear wall of the main body 1011 at the lower end of the main body 1011. The projection 1014 stops the chamber sleeve 102 from dropping below the wrench element 101 when the chamber sleeve 102 is placed over the wrench element 101.

In order to accommodate pressure relief valves, outlets, or any other projections from the main body of the valve 12, the wrench element 101 may optionally include a protrusion port 1015 in the rear wall of the main body 1011. The protrusion port 1015 allows any element protruding from the valve 12 to extend past the inner side of the rear wall of the main body 1011. This feature allows the user to properly align the wrench element 101 on the valve 12 regardless of irregularities in the geometry of the valve. A typical protrusion from the main body of the valve would be a pressure relief valve or an outlet.

An upper end of the wrench element 101 may also include aligned through holes so as to form a torque handle throughway 1016. The torque handle 103 may then be placed in the throughway 1016 to allow the user to apply more torque to the wrench 10 than would otherwise be possible.

The valve 12 is enclosed and secured in the wrench element 101 by the chamber sleeve 102, shown in detail in FIGS. 6–9. The chamber sleeve 102 includes a tubular main body 1021 that corresponds to the wrench element 101 in cross sectional geometry. However, the chamber sleeve 102 is larger than the wrench element 101, the chamber sleeve being sized so that the wrench element 101 can be received in the interior of the chamber sleeve 102. When the chamber sleeve 102 is placed over the wrench element 101, they together form a chamber that encloses the valve to be operated on.

The chamber sleeve 102 includes at its lower end a first arched opening 1022 in its front side and a second arched opening 1023 in its rear side. The first arched opening 1022 corresponds in location to the area between the arms 1013 of the wrench element 101 and the lower portion of the cutout area 1012. The second arched opening 1023 corresponds in location to the protrusion port 1015. The arched openings 1022, 1023 accommodate any projection on the valve such as a pressure release valve or the outlet of the valve 12, depending on the conformation of the specific valve. In the preferred embodiment, the top of the arched opening 1022 may rest on the top of the pressure relief valve or the outlet of the valve 12.

The openings 1022, 1023 are, in the preferred embodiment, surrounded and supported by a first exterior reinforcing plate 1024 and a second exterior reinforcing plate 1025 respectively. Because of the large amount of material required to be cut out of the main body 1021 of the chamber sleeve 102, the sleeve is susceptible to splitting when torque is applied to the wrench to remove or insert a valve. The reinforcing plates are placed on the exterior of the sleeve 102 so that sufficient room is available for valve projections to be received within the arched openings 1022, 1023.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

We claim:

1. A wrench adapted to fit on a valve of a pressurized gas canister or tank comprising:

a wrench element and a chamber sleeve;

said wrench element comprises a tubular main body, said main body of said wrench element comprises a cutout area that receives the valve, said cutout area accommodates any protrusions on a front facing side of the valve, said wrench element includes at a lower end of said cutout area a pair of securing arms, said securing arms include opposing flat surfaces adapted to abut flat sides of the valve to hold the valve securely in position in said wrench element, and said wrench element further includes at said lower end a restraining projection, and said chamber sleeve comprises a tubular main body, said main body of said chamber sleeve has a geometry that enables said wrench element to be received in an interior of said chamber sleeve, said chamber sleeve comprises a first opening situated so as to align with said cutout area of said wrench element when said chamber sleeve is placed over said wrench element; wherein when said wrench element is placed over the valve and said chamber sleeve is placed over said wrench element, said restraining projection inhibits a lower end of said chamber sleeve from passing over said lower end of said wrench element, said chamber sleeve and said wrench element thereby forming a chamber to secure the valve so that rotation of said chamber causes the valve to rotate therewith.

2. The wrench of claim 1 wherein:

said wrench element includes a torque handle throughway adapted to receive a torque handle placed therein, such that a user of said wrench can easily apply torque.

3. The wrench of claim 1 wherein:

said opening in said chamber sleeve is reinforced by an exterior reinforcing plate to provide added resistance to torque for said chamber sleeve.

4. The wrench of claim 1 wherein:

said wrench element includes a protrusion port in a rear wall of said main body of said wrench element, said protrusion port allows any projection from the valve to extend past an inner side of said rear wall of said main body of said wrench element.

5. The wrench of claim 4 wherein:

said chamber sleeve includes a second opening situated so as to align with said protrusion port of said wrench element when said chamber sleeve is -placed over said wrench element.

6. The wrench of claim 5 wherein:

each of said openings in said chamber sleeve is reinforced by an exterior reinforcing plate to provide added resistance to torque for said chamber sleeve.

7. A wrench adapted to fit on a valve of a pressurized gas canister or tank comprising:

a wrench element and a chamber sleeve;

said wrench element comprises a tubular main body, said main body of said wrench element comprises a cutout area that receives the valve, said cutout area accommodates any protrusions on a front facing side of the valve, said main body further comprises a protrusion port in a rear wall thereof, said protrusion port allows any projection from the valve to extend past an inner side of said rear wall of said main body of said wrench element, said wrench element includes at a lower end of said cutout area a pair of securing arms, said securing arms include opposing flat surfaces adapted to abut flat sides of the valve to hold the valve securely in position in said wrench element, and said wrench element further includes at said lower end a restraining projection, and said chamber sleeve comprises a tubular main body, said main body of said chamber sleeve has a geometry that enables said wrench element to be received in an interior of said chamber sleeve, said chamber sleeve comprises a first opening situated so as to align with said cutout area of said wrench element when said chamber sleeve is placed over said wrench element, and a second opening situated so as to align with said protrusion port of said wrench element when said chamber sleeve is placed over said wrench element; wherein when said wrench element is placed over the valve and said chamber sleeve is placed over said wrench element, said restraining projection inhibits a lower end of said chamber sleeve from passing over said lower end of said wrench element, said chamber sleeve and said wrench element thereby forming a chamber to secure the valve so that rotation of said chamber causes the valve to rotate therewith.

8. The wrench of claim 7 wherein:

said wrench element includes a torque handle throughway adapted to receive a torque handle placed therein, such that a user of said wrench can easily apply torque.

9. The wrench of claim 7 wherein:

said openings in said chamber sleeve are reinforced by exterior reinforcing plates to provide added resistance to torque for said chamber sleeve.

* * * * *